US009925817B2

(12) United States Patent
Tsuchihashi et al.

(10) Patent No.: US 9,925,817 B2
(45) Date of Patent: Mar. 27, 2018

(54) DECOLORIZING APPARATUS

(75) Inventors: Hiroyuki Tsuchihashi, Shizuoka-ken (JP); Kikuo Mizutani, Shizuoka-ken (JP); Hidetoshi Yokochi, Shizuoka-ken (JP); Isao Yahata, Shizuoka-ken (JP); Takahiro Kawaguchi, Shizuoka-ken (JP); Yoshiaki Sugizaki, Shizuoka-ken (JP); Hiroyuki Taki, Shizuoka-ken (JP); Ken Iguchi, Shizuoka-ken (JP); Chiaki Iizuka, Shizuoka-ken (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 948 days.

(21) Appl. No.: 13/492,666

(22) Filed: Jun. 8, 2012

(65) Prior Publication Data

US 2012/0315591 A1 Dec. 13, 2012

Related U.S. Application Data

(60) Provisional application No. 61/495,286, filed on Jun. 9, 2011, provisional application No. 61/499,158, filed on Jun. 20, 2011, provisional application No. 61/499,148, filed on Jun. 20, 2011, provisional application No. 61/499,153, filed on Jun. 20, 2011.

(51) Int. Cl.
*F27D 7/00* (2006.01)
*B41M 7/00* (2006.01)

(52) U.S. Cl.
CPC ..... *B41M 7/0009* (2013.01)

(58) Field of Classification Search
USPC ..... 432/65
See application file for complete search history.

(56) References Cited

U.S. PATENT DOCUMENTS 4,071,735 A * 1/1978 Moser ..... 219/216
5,356,507 A * 10/1994 Wojtanowitsch ... B32B 37/0053 100/330
5,405,726 A * 4/1995 Abe ..... G03G 9/0926 283/85
5,572,311 A * 11/1996 Abe et al. ..... 399/127
5,607,534 A * 3/1997 Kawanishi ..... B41M 7/0009 15/77

(Continued)

FOREIGN PATENT DOCUMENTS

JP 10-293483 11/1998

*Primary Examiner* — Nathaniel Herzfeld
(74) *Attorney, Agent, or Firm* — Patterson & Sheridan, LLP

(57) ABSTRACT

An erasing apparatus of embodiments has a color erasing device, the color erasing device has: a first heating member; a second heating member provided at a position facing the first heating member so as to form a nip portion therebetween through which the sheet is passed; a halogen lamp configured to heat the second heating member from outside thereof; and a reflector provided at a position opposite to the second heating member with the halogen lamp interposed therebetween and having a reflective surface configured to reflect heat received from the halogen lamp toward the second heating member, the reflector forming a guiding section configured to be in sliding contact with the sheet being conveyed so as to guide the sheet to the nip portion, the guiding section being heated by the halogen lamp.

12 Claims, 8 Drawing Sheets

(56) References Cited

U.S. PATENT DOCUMENTS

| | | | | |
|---|---|---|---|---|
| 5,887,238 | A * | 3/1999 | Matsuzoe et al. | 399/336 |
| 6,032,015 | A * | 2/2000 | Umeda | G03G 15/2053 399/306 |
| 6,898,410 | B2 * | 5/2005 | Boss | G03G 15/2053 219/216 |
| 7,526,242 | B2 | 4/2009 | Takagaki et al. | |
| 8,548,368 | B2 * | 10/2013 | Hollands et al. | 399/331 |
| 2005/0134670 | A1 * | 6/2005 | Yamamoto et al. | 347/179 |
| 2008/0050155 | A1 * | 2/2008 | Miki | G03G 15/2064 399/328 |
| 2009/0154970 | A1 * | 6/2009 | Yoshida | G03G 15/6588 399/341 |
| 2010/0128327 | A1 * | 5/2010 | Maeshima | H04N 1/00572 358/474 |
| 2010/0194839 | A1 * | 8/2010 | Taguchi | B41J 2/32 347/179 |
| 2010/0232844 | A1 * | 9/2010 | Saito | G03G 15/1605 399/307 |
| 2011/0234721 | A1 * | 9/2011 | Endo | 347/101 |
| 2013/0243504 | A1 * | 9/2013 | Terao | 399/341 |

* cited by examiner

DECOLORIZING APPARATUS

This application is based upon and claims the benefit of priority from: U.S. provisional application 61/495,286, filed on Jun. 9, 2011; 61/499,158, filed on Jun. 20, 2011; 61/499,148, filed on Jun. 20, 2011; 61/499,153, filed on Jun. 20, 2011, the entire contents of all of which are incorporated herein by reference.

FIELD

Embodiments described herein relate generally to a color erase (decolorization) processing technique for color erasing (decolorizing) an image printed on a sheet using a color erasable material (decolorable material) which is color erased (decolorized) by a heating treatment thereto.

BACKGROUND

There has been an erasing apparatus for color erasing (decolorizing) an image on a sheet. The erasing apparatus includes a color erasing device (decolorizing section) which performs a heating treatment on a sheet with a printed image so as to color erase (decolorize) the image (color material) on the sheet.

The color erasing device heats the sheet up to a predetermined temperature (decolorization temperature) so as to color erase the image. In order to reuse such a sheet, it is desired to reduce, as much as possible, a non color erased (non-decolorized) portion of the image left after the color erasing process thereto.

DETAILED DESCRIPTION

An erasing apparatus according to the present embodiment is an erasing apparatus including a color erasing device configured to heat a sheet having an image formed thereon using a color material that is erased at a predetermined color erasing temperature so as to erase color of image. The color erasing device can include: a first heating member configured to be heated to a temperature greater than or equal to the color erasing temperature by a first heat source and to be in contact with a first surface of the sheet being conveyed; a second heating member provided at a position facing the first heating member so as to form a nip portion therebetween through which the sheet is passed and configured to be in contact with a second surface of the sheet; a second heat source configured to heat the second heating member from outside thereof; and a reflective member provided at a position opposite to the second heating member with the second heat source interposed therebetween and having a reflective surface configured to reflect heat received from the second heat source toward the second heating member, the reflective member forming a first guiding section configured to be in sliding contact with the second surface of the sheet being conveyed so as to guide the sheet to the nip portion, the first guiding section being heated by the second heat source.

The erasing apparatus according to the present embodiment will be described in detail below with reference to the drawings.

First Embodiment

Figure 1:
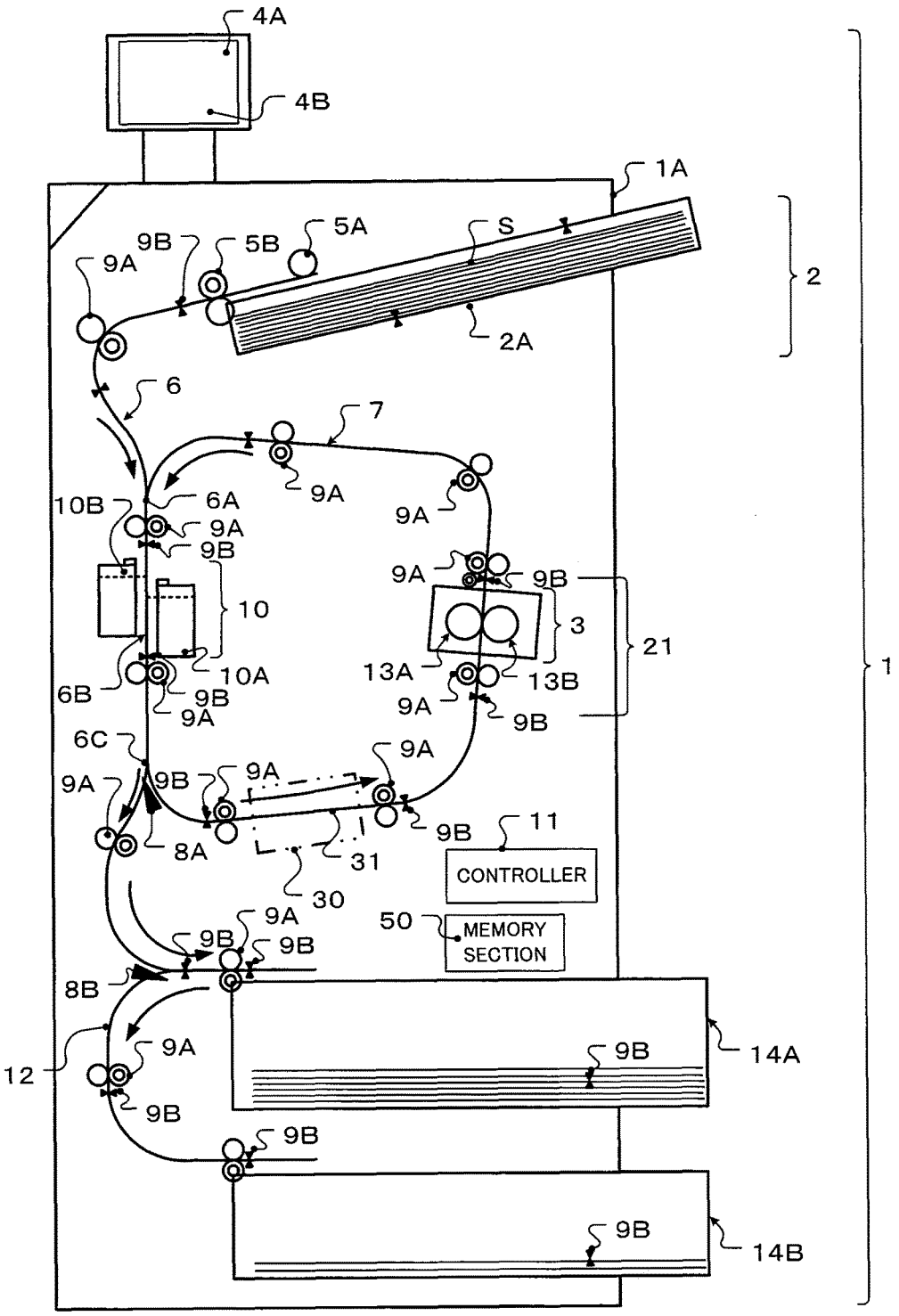
FIG. 1 is a schematic cross-sectional side view showing an entire configuration of an erasing apparatus according to a first embodiment.
Figure 2:
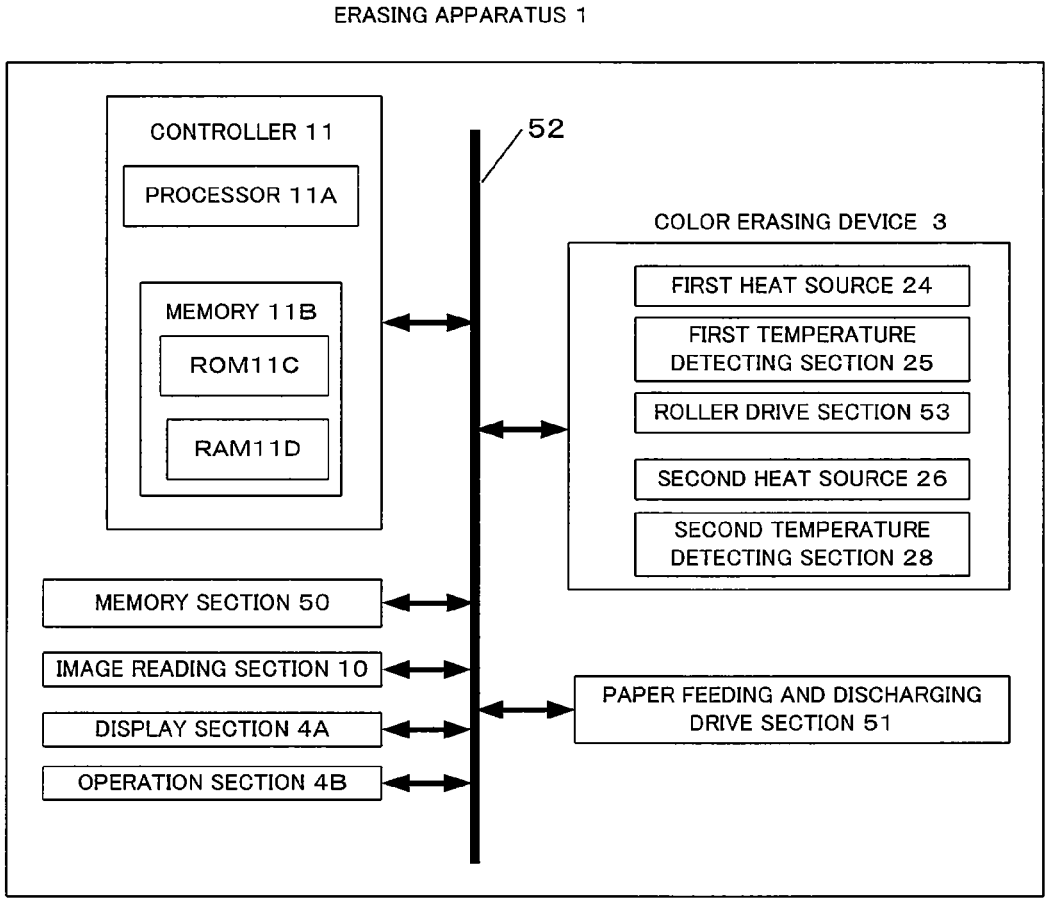
FIG. 2 is a control block diagram showing an embodiment of a control device for controlling the entire operation of the erasing apparatus shown in FIG. 1.
Figure 3:
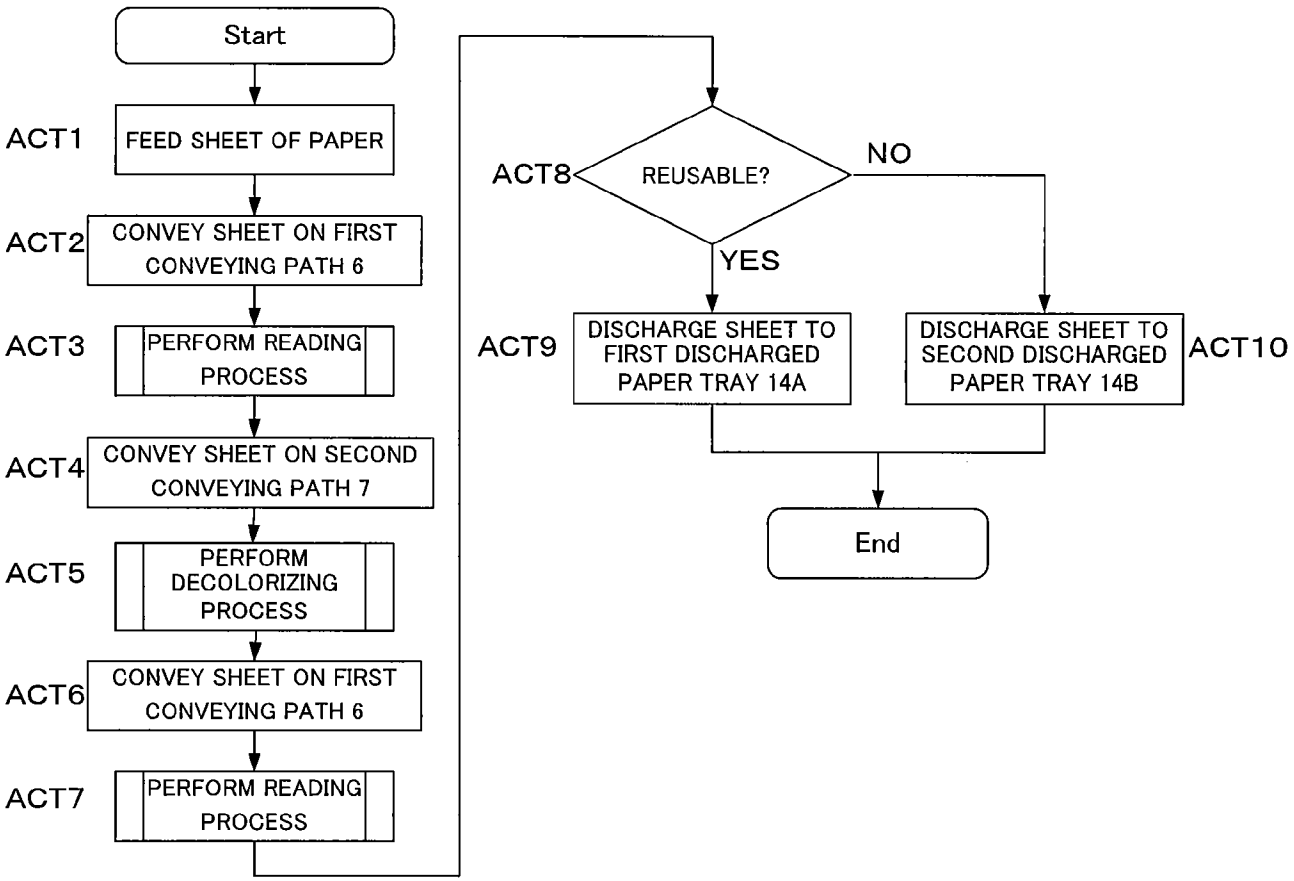
FIG. 3 is a flow chart showing a process flow of the control device shown in FIG. 2.

FIG. 1 is a schematic cross-sectional side view showing an entire configuration of the erasing apparatus. FIG. 2 is a control block diagram showing an embodiment of a control device for controlling the entire operation of the erasing apparatus shown in FIG. 1. FIG. 3 is a flow chart showing a process flow of the control device shown in FIG. 2.

In FIG. 1, the erasing (decolorizing) apparatus 1 includes: a paper feeding section 2 for feeding a plurality of sheets S to be subjected to a color erasing process (decolorizing process); a color erasing device (decolorizing section) 3; a display section 4A; an operation section 4B; a first conveying path 6; a second conveying path 7; a first flapper 8A used for switching between sheet conveyance to the first conveying path 6 and that to the second conveying path 7; a second flapper 8B for switchback; conveying rollers 9A; sheet detection sensors 9B; an image reading section 10; a controller 11; a third conveying path 12; a first discharged paper tray 14A; a second discharged paper tray 14B; and a memory section 50.

The paper feeding section 2 includes: a stacker 2A in which a plurality of sheets S to be subjected to a color erasing process (decolorizing process) are stacked; a pickup roller 5A; and a paper feeding roller 5B. The sheets S may possibly include a sheet on which an image has been formed using a non-color erasable material (non-decolorable material) in addition to a sheet on which an image has been formed using a color erasable material which is color erased at a color erasing temperature thereof when heated. Moreover, the stacker 2A can contain stacked sheets of various sizes such as A4, A5, and the letter size, for example. An image formed by a color erasable material is obtained by forming it on a sheet by an electrophotographic type or ink-jet type image forming device, for example.

According to the present embodiment, while images formed on the both surfaces of a sheet can be simultaneously color erased at the color erasing device 3, it is also possible to perform a color erasing process only on one surface of the sheet. A selection between processing for both surfaces and processing for one surface may be performed by a user operating the touch-panel type operation section 4B, for example, while looking at a display screen of the display section 4A for displaying a setting screen or the like. Note that the following description will be made regarding to a case where a simultaneous color erasing process for the both surfaces of a sheet is selected.

The sheets S stacked in the stacker 2A are taken out one by one with the pickup roller 5A, and fed to the first conveying path 6 by the paper feeding roller 5B. A conveyance terminating end of the first conveying path 6 is positioned at the conveying roller 9A of the first discharged paper tray 14A. In the midway along the first conveying path 6, there are provided, from an upstream side toward a downstream side in a conveying direction, a merging section 6A, an inspection area 6B, and a branching section 6C. A conveyance terminating end of the second conveying path 7 is connected to the merging section 6A, and a conveyance starting end of the second conveying path 7 is connected to the branching section 6C. The first flapper 8A is disposed at the branching section 6C so as to switch a conveying direction of a sheet being conveyed on the first conveying path 6 between toward the first discharged paper tray 14A and toward the second conveying path 7. The image reading section 10 is disposed in the inspection area 6B on the first conveying path 6. Further, the color erasing device 3 is disposed at a sheet conveying path section 21 extending vertically on the second conveying path 7.

A conveyance route of the sheet S fed onto the first conveying path 6 from the stacker 2A is appropriately changed based on a processing mode performed by the erasing apparatus 1. The erasing apparatus 1 has a plurality of processing modes. For example, the erasing apparatus 1 has: (1) a first color erasing mode with which image reading is not performed and only a color erasing process is performed; (2) a second color erasing mode with which a color erasing process is performed after the reading of an image; (3) a third color erasing mode with which a reading process before color erasing is not performed and a determination whether the sheet S is reusable or not (determination process) is performed after a color erasing process; (4) a fourth color erasing mode with which a color erasing process is performed after the reading of an image and the determination process is further performed; and (5) a reading mode with which the erase color of an image is not performed but an image reading process is performed.

A selection from among the modes described above can be made at the operation section 4B of the erasing apparatus 1. The selection method of the processing mode is not limited to the operation section 4B of the erasing apparatus 1, and such a selection may be set from an external terminal. In the first to fourth color erasing modes, a sheet is always conveyed to the color erasing device 3. In the reading mode, on the other hand, the erasing apparatus 1 controls the first flapper 8A so as to discharge the sheet S via the image reading section 10 without conveying the sheet S to the color erasing device 3.

A color erasing process in accordance with the fourth color erasing mode will now be described.

A sheet S fed onto the first conveying path 6 from the stacker 2A is passed through the image reading section 10 so that images on the both surfaces thereof are read. Then, the first flapper 8A switches a conveying direction of the sheet S to the second conveying path 7 side for a color erasing process. The sheet S being conveyed on the second conveying path 7 is conveyed in an upward direction along the sheet conveying path section 21, and heated and thereby color erased at the color erasing device 3. The sheet S passed through the color erasing device 3 and thereby subjected to the color erasing process is fed from the second conveying path 7 to the first conveying path 6 at the merging section 6A, and the both surfaces thereof are read again at the image reading section 10.

The image reading section 10 includes a first scanner section 10A and a second scanner section 10B disposed at the both sides of the conveying path for a sheet S. The image reading section 10 reads both of the front surface and back surface of the sheet S being conveyed with the first scanner section 10A and the second scanner section 10B, and sends the information of the read image to the controller 11 and the memory section 50. A surface of the sheet S facing inwardly is herein referred to as a first surface, and a surface thereof facing outwardly is herein referred to as a second surface, with the sheet S being conveyed on the second conveying path 7. The first scanner section 10A is configured to read the first surface of the sheet S, and the second scanner section 10B is configured to read the second surface of the sheet S. Since the image information read at the image reading section 10 before the color erasing process is stored in the memory section 50, the image data obtained before the color erasing can be called up even after the image is color erased at the color erasing device 3.

The color erasing device 3 heats both surfaces of the sheet S simultaneously at a predetermined color erasing temperature by a first heating section 13A and a second heating section 13B disposed so as to face each other at the both sides of the conveying path for a sheet S.

The entire front and back surfaces of the sheet S passed through the color erasing device 3 and thereby subjected to the color erasing process are read by the first scanner section 10A and the second scanner section 10B of the image reading section 10.

A color erasing appropriateness is determined at the controller 11 based on the read information for the first and second surfaces of the sheet S read by the first scanner section 10A and the second scanner section 10B. A determination result to be appropriate color erasing exemplifies a case where no image is left since the color erasing process at the color erasing device 3 has been performed sufficiently or a case where a non-color erased portion of the image exists but to the extent that the portion is barely noticeable and the sheet is therefore reusable. A determination result to be inappropriate color erasing exemplifies a case where the color erasing process has been performed insufficiently and a color erasable image left non-color erased therefore exists to the noticeable extent. This determination result also includes a case where there exists a handwritten image produced by using a non-color erasable ink or the like, or a case where an image has been formed by a non-color erasable material.

The sheet S, after being subjected to the color erasing appropriateness determination process, is conveyed toward the branching section 6C on the first conveying path 6. At this time, the first flapper 8A is being retracted from the first conveying path 6, and the sheet S after being subjected to the color erasing appropriateness determination process is thereby conveyed toward the first discharged paper tray 14A.

The first discharged paper tray 14A and the second discharged paper tray 14B are disposed at two positions along a vertical direction in the lower part of an apparatus body 1A of the erasing apparatus 1. The first discharged paper tray 14A and the second discharged paper tray 14B are connected to each other by the third conveying path 12 including the second flapper 8B for switchback.

The sheet S after being subjected to the color erasing process and sent out toward the first discharged paper tray 14A temporarily stands by at the conveyance terminating end of the first conveying path 6, and waits for the color erasing appropriateness determination. The reusable sheet S determined at the controller 11 to have the appropriate color erasing result is conveyed as it is and discharged into the first discharged paper tray 14A. If the sheet S is determined at the controller 11 to have the inappropriate color erasing result, on the other hand, the second flapper 8B then switches the third conveying path 12 to an open direction so as to convey the non-reusable sheet S waited at the terminating end of the first conveying path 6 and determined to have the inappropriate color erasing result toward the third conveying path 12 and discharge the sheet S to the second discharged paper tray 14B.

Thus, it is possible to form a color erasable image again on the sheet discharged to the first discharged paper tray 14A using a color erasable material and to form images on the same sheet again and again using a color erasable material.

As shown in FIG. 2, the controller 11 includes a processor 11A formed by a CPU (Central Processing Unit) or an MPU (Micro Processing Unit), and a memory 11B. The controller 11 controls the image reading section 10, the color erasing device 3, the display section 4A, and the operation section 4B. The memory 11B may be a semiconductor memory, for example, and includes a ROM (Read Only Memory) 11C for storing various control programs and a RAM (Random Access Memory) 11D for providing a temporal working area for the processor 11A. For example, the ROM 11C stores a printing ratio on a sheet of paper used as a threshold to determine whether or not the sheet of paper is reusable, a concentration threshold used to determine whether or not an image has been color erased, and the like. The RAM 11D may temporarily store images read at the image reading section 10. The components of the erasing apparatus 1 are connected to one another via a bus 52.

Moreover, the memory section 50 stores application programs and an operating system. The application programs include programs to execute functions possessed by the erasing apparatus such as the reading function by the image reading section 10 and the color erasing function by the color erasing device. The application programs further include a Web client application (Web browser) or other applications. The memory section 50 stores therein the number of sheets processed by the erasing apparatus 1. The memory section 50 may be, for example, a hard disk drive, another magnetic storage device, an optical storage device, a semiconductor memory device such as a flash memory, or any combination of these.

In the block diagram shown in FIG. 2, a paper feeding and discharging drive section 51 includes drive motors for respectively driving the pickup roller 5A, the paper feeding roller 5B, the plurality of conveying rollers 9A, the first flapper 8A, and the second flapper 8B described above for performing the paper feed and paper discharge of a sheet S, the plurality of sheet detection sensors 9B for detecting a sheet, and the like. The paper feeding and discharging drive section 51 is driven by the controller 11 and conveys the sheet S in accordance with the flow chart shown in FIG. 3.

The color erasing device 3 includes: a first heat source 24 for heating the first heating section 13A; a first temperature detecting section 25 for detecting a surface temperature of the first heating section 13A; a roller drive section 53 for driving the first heating section 13A and the second heating section 13B of roller structures; a second heat source 26 for heating the second heating section 13B; and a second temperature detecting section 28 for detecting a surface temperature of the second heating section 13B. The color erasing device 3 is temperature-controlled at a predetermined temperature by the controller 11, and the first heating section 13A and the second heating section 13B are rotary-driven by the controller 11.

FIG. 3 is a flow chart showing operations of a conveyance process for a sheet S performed by the control block shown in FIG. 2.

When a color erasing process operation is started, the paper feeding section 2 feeds a sheet S (ACT1), and the sheet S is conveyed to the first conveying path 6 (ACT2).

The both surfaces of the sheet S are read at the image reading section 10 on the first conveying path 6 (ACT3), and the sheet S is conveyed to the second conveying path 7 branched from the first conveying path 6 (ACT4) to proceed to ACT5. Note that the read information is transmitted to the controller 11 and the memory section 50.

In ACT5, the sheet S is conveyed to the sheet conveying path section 21 on the second conveying path 7 and the sheet S is subjected to the color erasing process at the color erasing device 3. Then, the sheet S after being subjected to the color erasing process is conveyed to an image inspection conveyance path section 7B (ACT6), the both surfaces of the sheet S after being subjected to the color erasing process are read at the image reading section 10 (ACT7), and the read information is transmitted to the controller 11.

The controller 11 determines a color erased state of the color erasable image based on the read information of the sheet S after being subjected to the color erasing process (ACT8). At this time, this read information is also compared with the image information of the sheet S read before the color erasing process so as to obtain a percentage of an image left non-color erased, a concentration thereof, and the like, thereby determining whether or not the sheet S is reusable.

The sheet S determined in ACT8 to be reusable is stacked on the first discharged paper tray 14A (ACT9), and the sheet S determined to be non-reusable is stacked on the second discharged paper tray 14B (ACT10). Thus, the flow is ended.

Figure 4:
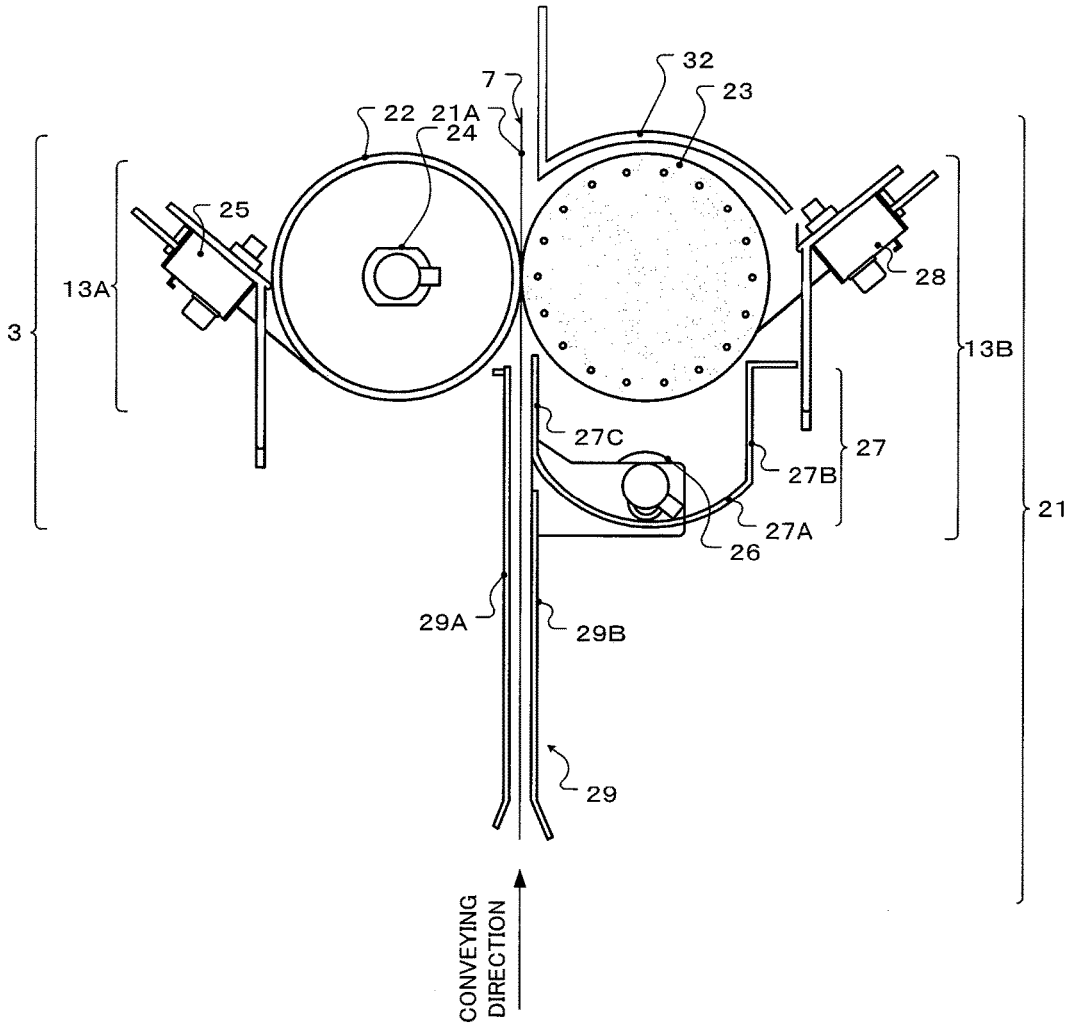
FIG. 4 is a longitudinal cross-sectional view showing a color erasing device included in the erasing apparatus of FIG. 1.

FIG. 4 shows a configuration of the color erasing device 3 shown in FIG. 1.

The color erasing device 3 shown in FIG. 4 is disposed in the sheet conveying path section 21 provided along the vertical direction on the second conveying path 7.

The color erasing device 3 of the present embodiment includes the first heating section 13A disposed at the inner side of the second conveying path 7 and the second heating section 13B disposed at the outer side thereof with a sheet conveying surface 21A of the sheet conveying path section 21 interposed therebetween. Moreover, a first roller (first heating member) 22 forming the first heating section 13A and a second roller (second heating member) 23 forming the second heating section 13B are disposed so as to face each other. The sheet S is conveyed through a nip portion between the first roller 22 and the second roller 23.

In the present embodiment, the first roller 22 is formed to be a hollow roller made of a hard material such as a metal (hard roller). The first heat source 24 is disposed in the hollow portion of the first roller 22 along the axial direction thereof. The first roller 22 is heated from inside thereof by the first heat source 24, and the temperature of the outer surface thereof is detected by the first temperature detecting section 25. The first heat source 24 may be a halogen lamp, for example.

Figure 5:
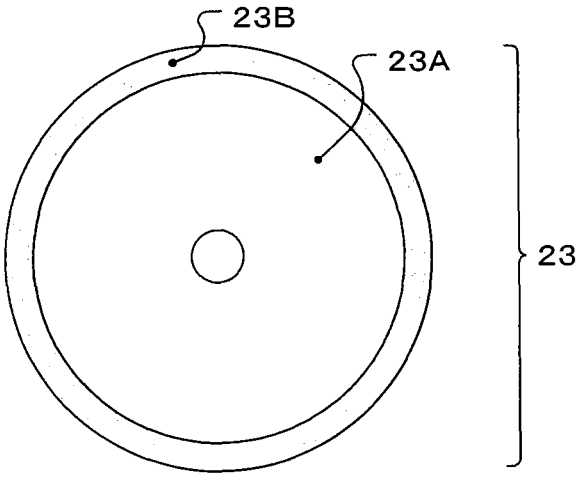
FIG. 5 is a cross-cross-sectional view of a second roller forming the color erasing device.

The second roller 23 may be formed to have a roller shape using an elastic and flexible member (soft roller). The second roller 23 may have a configuration such that a surface layer 23B made of PFA (fluorine resin) having mold releasability is formed on the surface of an inner layer 23A made of a silicon sponge having elasticity as shown in FIG. 5, for example. Thus, the second roller 23 contacts the outer periphery of the first roller 22 with a certain width. The second heating section 13B includes the second heat source 26 disposed outside the second roller 23, and the outer surface of the second roller 23 is heated by the second heat source 26. The second heat source 26 is disposed on an upstream side in the sheet conveying direction as viewed from the nip portion.

The second heat source 26 may be a halogen lamp which emits light over the entire circumference thereof, for example, and the second heat source 26 extends along the axial direction of the second roller 23. On the back surface side of the second heat source 26 (an upstream side of the second heat source 26 in the sheet conveying direction), there is provided a reflector (reflecting member) 27 forming the second heating section 13B along the axial direction of the second heat source 26.

The reflector 27 includes a first reflecting section 27A having a concave reflective surface disposed on the back surface side of the second heat source 26, and a second reflecting section 27B and a third reflecting section 27C provided so as to be connected to the both ends of the first reflecting section 27A respectively and extended toward the downstream side in the sheet conveying direction. The reflector 27 reflects light (heat) radiated from the second heat source 26 toward the outer surface of the second roller 23. Heat radiated from the second heat source 26 is directly transferred also to the second reflecting section 27B and the third reflecting section 27C, or a reflected heat from the first reflecting section 27A is transferred to the second reflecting section 27B or the third reflecting section 27C through air. Moreover, a front edge of the third reflecting section 27C is extended up to a position as close as possible to the outer periphery of the second roller 23.

The surface of the second roller 23 is heated by the heat directly radiated from the second heat source 26 and the reflected heat by the reflector 27. The surface temperature of the second roller 23 is then detected by the second temperature detecting section 28.

In the present embodiment, the sheet conveying path section 21 is provided with a sheet guiding section 29 for guiding the sheet S being conveyed toward the nip portion between the first roller 22 and the second roller 23. In the sheet guiding section 29, an inner guide plate 29A disposed at the inner side and an outer guide plate 29B disposed at the outer side are disposed so as to face each other with the sheet conveying surface 21A interposed therebetween. A front edge of the inner guide plate 29A on the downstream side in the sheet conveying direction is extended up to a position as close as possible to the outer periphery of the first roller 22. A front edge of the outer guide plate 29B on the downstream side in the sheet conveying direction is extended up to a position close to the rear side of the third reflecting section 27C of the reflector 27. The third reflecting section 27C is disposed along an extended line from the outer guide plate 29B so that the third reflecting section 27C functions also as a part of the sheet guiding section 29 (first guiding section).

The reflector 27 is formed by a material excellent in heat conductivity such as stainless steel. Heat from the first reflecting section 27A is transferred to the third reflecting section 27C, thereby heating the third reflecting section 27C. Moreover, the radiated heat from the second heat source 26 directly impinges on the third reflecting section 27C and the reflected heat from the first reflecting section 27A also impinges on the third reflecting section 27C. As a result, the temperature of the third reflecting section 27C is increased. Thus, the second surface side of the sheet S conveyed while being guided by the sheet guiding section 29 is preheated by the third reflecting section 27C when passing by the third reflecting section 27C at a position before entering the nip portion between the first roller 22 and the second roller 23.

In other words, the reflector 27 forms a first guiding section having a guiding surface to be in sliding contact with the second surface of the sheet S being conveyed for guiding the sheet S to the nip portion. The first guiding section is heated by the second heat source 26.

The second roller 23, which is a soft roller, has a tendency such that the surface temperature thereof is hard to increase. Thus, if the sheets S are continuously passed through the second roller 23, the surface temperature thereof is easy to decrease. Accordingly, there is a risk of deteriorating the color erasing quality such as insufficient color erasing of a color erasable image on the second surface of the sheet S in contact with the second roller 23. On the other hand, the first roller 22 has an excellent heat storage property. As a result, a variation in the surface temperature of the first roller 22 is small even when the sheets S are continuously passed therethrough. Thus, the first roller 22 is stably maintained at a predetermined color erasing temperature.

According to the present embodiment, however, the heat of the second heat source 26 is concentrated by the reflector 27 onto the outer periphery of the second roller 23, thereby keeping the surface temperature of the second roller 23 high. Moreover, before the sheet S enters the nip portion between the first roller 22 and the second roller 23 to undergo the color erasing process, the second surface of the sheet S is preheated by the third reflecting section 27C so as to increase the temperature thereof up to a certain temperature (a temperature lower than the color erasing temperature). Thus, even when a variation occurs in the surface temperature of the second roller 23, the color erasable image on the second surface can be sufficiently color erased, thereby achieving stabilization in color erasing quality.

According to the present embodiment, the second heat source 26 is disposed below the second roller 23 and the reflector 27 is disposed below the second heat source 26. Accordingly, the heat radiated from the second heat source 26 creates an ascending current and thereby heats the second roller 23 from the underneath thereof. Thus, the entire outer periphery of the second roller 23 can be heated due to the heat of the ascending current from the second heat source 26 in addition to the reflection effect of the reflector 27. It is therefore possible to minimize a temperature variation on the outer periphery of the second roller 23 and to color erase the color erasable image on the second surface sufficiently. As a result, stabilization in color erasing quality can be achieved.

In the present embodiment, on the inner periphery of the reflector 27, the surface of the third reflecting section 27C may be painted with a color having an excellent heat collection property such as a black color and may be provided with concavity and convexity in order to increase a heat collection area thereof. As a result, the temperature of the third reflecting section 27C can be further raised.

Although the second roller 23 is used as a constituent element of the second heating section 13B in the present embodiment, it is not limited to a member having a roller shape. Any configuration may be employed as long as an elastic and flexible member can be in surface contact with the first roller 22 as a hard roller.

In addition to the reflector 27 provided with respect to the second roller 23 on the upstream side in the sheet conveying direction, a heat retention cover 32 partially covering the outer periphery of the second roller 23 may be disposed on the downstream side in the sheet conveying direction, i.e., the opposite side of the reflector 27 with the second roller 23 interposed therebetween, so as to prevent a reduction in the surface temperature of the second roller 23.

The surface temperatures of the first roller 22 and the second roller 23 are decreased if the sheets S are continuously passed therethrough. As a result, there is a risk of deteriorating the color erasing quality for a color erasable image on a sheet surface.

For example, when the surface temperature of the second roller 23, which is a soft roller, is decreased, the color erasing quality for a color erasable image on the sheet surface to be in contact with the second roller 23 deteriorates.

For example, there may be a case where the second roller 23 has a heat conductivity lower than that of the first roller 22 due to a difference therebetween in structure or the like. In this case, even when the first heat source 24 and the second heat source 26 are turned ON simultaneously, an amount of time required for the surface temperature of the second roller 23 to reach the predetermined color erasing temperature may possibly be greater than that for the first roller 22.

Thus, a controlled temperature for heating the second roller 23 is set to be higher than that for heating the first roller 22. Accordingly, the surface temperature of the second roller 23 can be maintained appropriately even when the surface temperature of the second roller 23 is decreased due to the sheets S continuously passed therethrough. In this case, the first heat source 24 sets the controlled temperature for heating the first roller 22 to a first temperature greater than or equal to the predetermined color erasing temperature and heats the first roller 22 at that temperature. The second heat source 26, on the other hand, sets the controlled temperature for heating the second roller 23 to a second temperature higher than the first temperature and heats the second roller 23 at that temperature. Thus, it is possible to minimize a temperature variation in the second roller.

Alternatively, the first heat source and the second heat source may be controlled so that the surface temperature of the first roller 22 is higher than the surface temperature of the second roller 23. For example, the controlled temperature of the first heat source for heating the first roller 22 may be set to be the first temperature greater than or equal to the predetermined color erasing temperature, and the controlled temperature of the second heat source for heating the second roller 23 may be set to a third temperature which is greater than or equal to the predetermined color erasing temperature and lower than the first temperature. In other words, the first heat source 24 heats the first roller 22 at the first temperature, and the second heat source 26 heats the second roller 23 at the third temperature lower than the first temperature. In this case, since the surface temperature of the first roller 22 is controlled so as to be higher than the surface temperature of the second roller 23, heat is transferred from the first roller 22 to the second roller 23. Such heat transfer makes it possible to decrease a degree of reduction in the surface temperature of the second roller 23 due to the sheets S continuously passed therethrough, and the surface temperature of the second roller 23 can be therefore maintained at the predetermined color erasing temperature.

Since the surface temperature of the second roller 23 can be maintained at the predetermined color erasing temperature with the aid of the heat transfer from the first roller 22, the color erasing quality can be stabilized.

Second Embodiment

Figure 6:
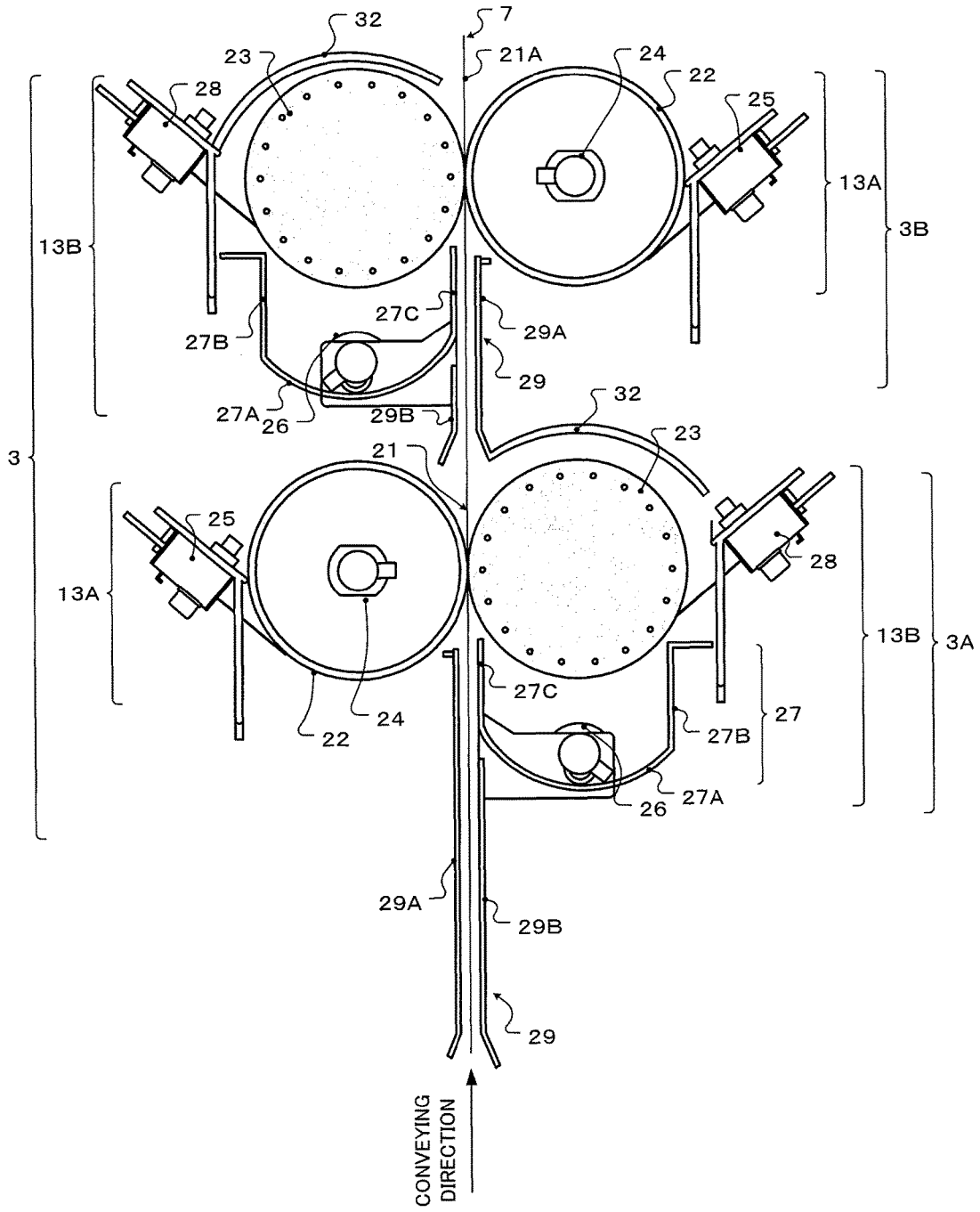
FIG. 6 is a longitudinal cross-sectional view showing a color erasing device included in an erasing apparatus according to a second embodiment.

FIG. 6 shows a second embodiment and a modification of the color erasing device shown in FIG. 4. Note that elements same as those in FIG. 2 will be denoted by the same reference numerals and the descriptions thereof will be omitted.

The color erasing device 3 of the present embodiment has a double structure such that a first color erasing device 3A and a second color erasing device 3B each having the same configuration as that of the color erasing device 3 shown in FIG. 2 are provided in the sheet conveying path section 21 so as to be separated from each other along a vertical direction and nip portions are provided at two places.

In the present embodiment, the first color erasing device 3A includes the second heating section 13B disposed at the outer side of the second conveying path 7 as with the configuration shown in FIG. 4, and the second color erasing device 3B positioned at the downstream side of the first color erasing device 3A in the sheet conveying direction includes the second heating section 13B disposed at the inner side of the second conveying path 7.

According to the present embodiment, the first color erasing device 3A performs a primary color erasing process on the first surface and the second surface of a sheet S. Immediately thereafter, the second color erasing device 3B performs a secondary color erasing process on the first surface and the second surface of the sheet S after being subjected to the primary color erasing process. On the second surface of the sheet S which has been heated by the second heating section 13B and thereby undergone the primary color erasing process, the color erasing quality thereof may possibly deteriorate due to various factors such as a type of the material and thickness of the sheet S, or the number of color erasing processes the sheet S has undergone. In this case, the color erasing quality can be improved by performing the secondary color erasing process on the sheet S by the second color erasing device 3B. In particular, since the second surface of the sheet S comes into contact with the first roller (third heating member) 22 which is a hard roller having a small temperature variation during the secondary color erasing process, a color erasable image left non-color erased can be color erased reliably.

The second roller 23 (fourth heating member) of the second color erasing device 3B comes into contact with the first surface of the sheet S. Moreover, as with the first embodiment, the reflector 27 forms a second guiding section having a guiding surface to be in sliding contact with the first surface of the sheet S being conveyed for guiding the sheet S to the nip portion. The second guiding section is heated by the second heat source 26.

Note that no reflector 27 may be provided in the second heating section 13B in the second color erasing device 3B. In other words, the sheet S enters the second color erasing device 3B while being heated already by the heating process performed by the first color erasing device 3A. Thus, a color erasing process can be performed sufficiently by the second roller (fourth heating member) 23 in the second color erasing device 3B without utilizing the reflector 27. It is also possible to dispose the second color erasing device 3B closer to the first color erasing device 3A on the upstream side thereof in such a way as to fill up the space created by eliminating the reflector 27. As a result, it is possible to reduce a temperature drop created while the sheet S passed through the first color erasing device 3A moves up to the second color erasing device 3B, and it is therefore possible to perform a color erasing process on the sheets S continuously passed therethrough at a stable color erasing temperature.

Moreover, as with the first embodiment, the heat retention cover 32 partially covering the outer periphery of the second roller 23 may be provided on the downstream side in the sheet conveying direction, which is the opposite side of the reflector 27 with the second roller 23 interposed therebetween, thereby preventing a reduction in the surface temperature of the second roller 23. At this time, the heat retention cover 32 may be provided for both of the second rollers 23 in the first color erasing device 3A and the second color erasing device 3B as shown in FIG. 6, or the heat retention cover 32 may be provided only for the second roller 23 in any one of the first color erasing device 3A and the second color erasing device 3B.

Moreover, the first heat source and a third heat source for heating the first rollers 22 respectively forming the first heating member and the third heating member and the second heat source 26 and a fourth heat source 26 for heating the second rollers 23 respectively forming the second heating member and the fourth heating member can be temperature-controlled in the same manner as that of the first embodiment.

Although the second color erasing device 3B has been described as having the same configuration as that of the first color erasing device 3A, the configuration of the second color erasing device 3B is not limited thereto. It may have a configuration different from that of the first color erasing device 3A in structure, size, and the like.

Third Embodiment

Figure 7:
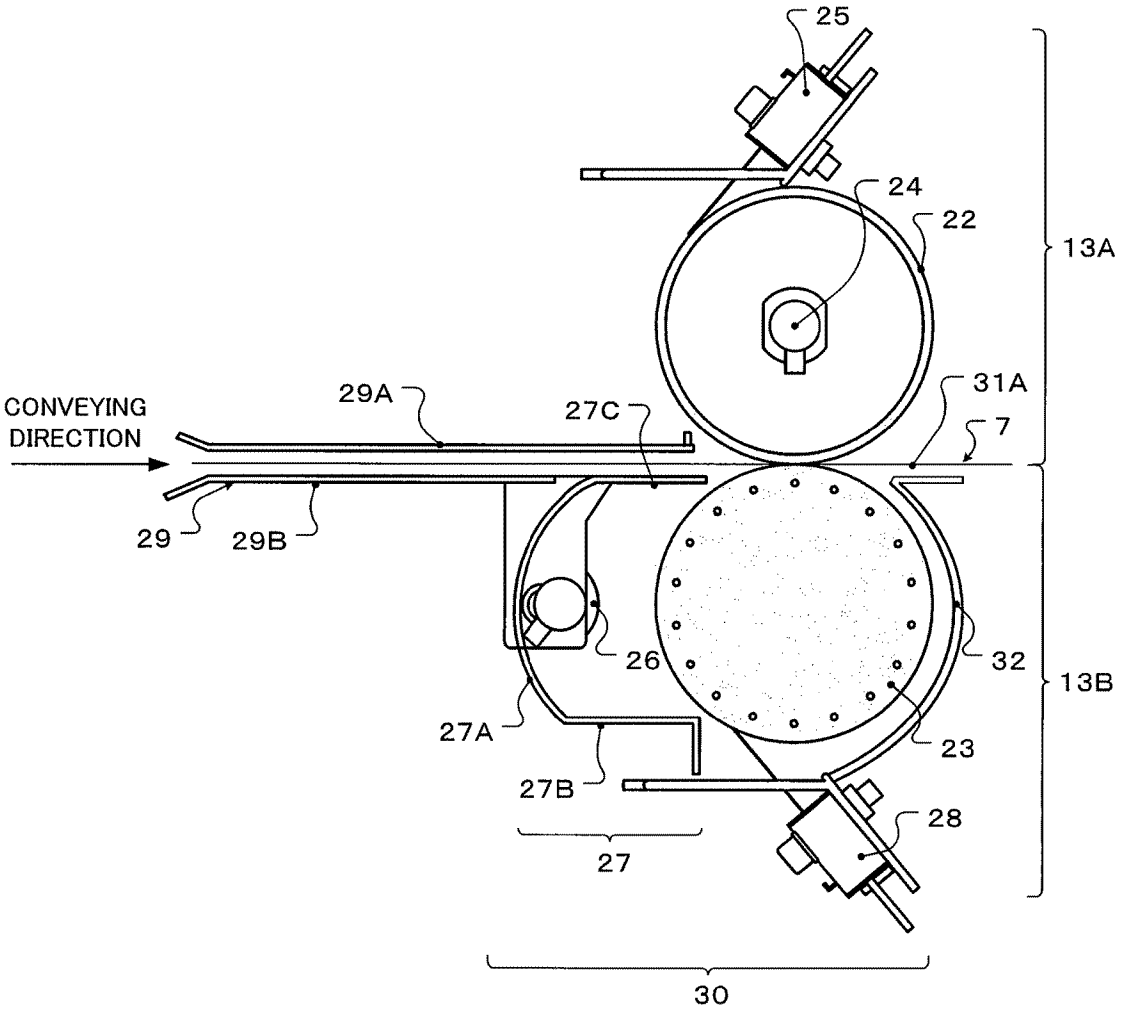
FIG. 7 is a longitudinal cross-sectional view showing a color erasing device included in an erasing apparatus according to a third embodiment.

FIG. 7 shows a third embodiment and a modification of the color erasing device shown in FIG. 4. Note that elements in FIG. 7 same as those in FIG. 4 will be denoted by the same reference numerals and the descriptions thereof will be omitted.

A color erasing device 30 of the present embodiment has the same configuration as that of the color erasing device 3 shown in FIG. 4, and may be provided for example in a sheet conveying path section 31 shown in FIG. 1 along a horizontal direction on the second conveying path 7. The second heating section 13B in the color erasing device 30 is disposed below a sheet conveying surface 31A of the sheet conveying path section 31 along the horizontal direction. In this case, since the third reflecting section 27C of the reflector 27 is positioned above the second heat source 26, the third reflecting section 27C is heated by an ascending current generated by the heat radiated by the second heat source 26. As a result, the preheat temperature for the sheet S can be raised.

Fourth Embodiment

Figure 8:
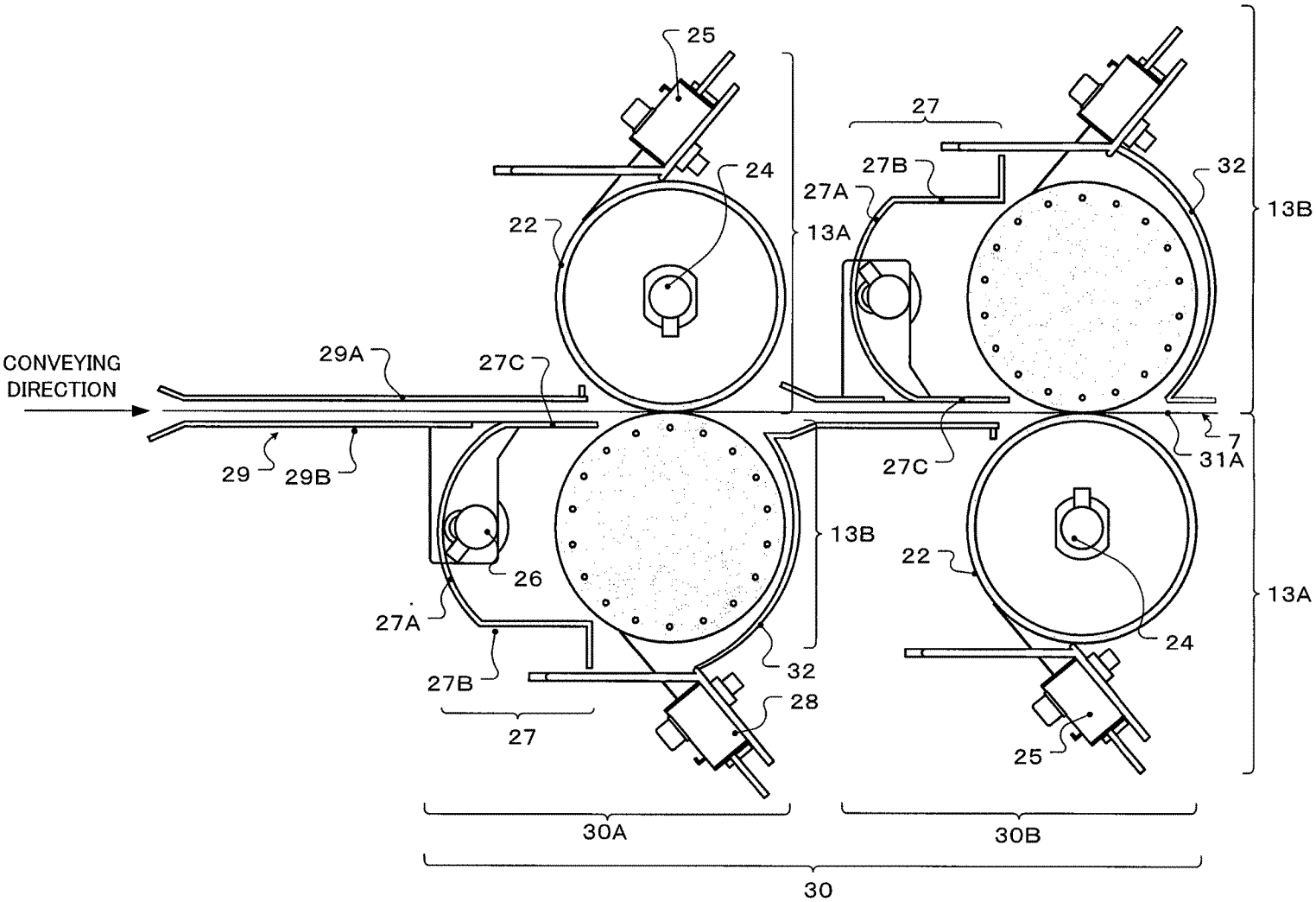
FIG. 8 is a longitudinal cross-sectional view showing a color erasing device included in an erasing apparatus according to a fourth embodiment.

FIG. 8 shows a fourth embodiment and a modification of the third embodiment shown in FIG. 7. Note that elements in FIG. 8 same as those in FIG. 7 will be denoted by the same reference numerals and the descriptions thereof will be omitted.

While the color erasing device 30 is disposed at the sheet conveying path section 31 along the horizontal direction in the third embodiment shown in FIG. 7, a first color erasing device 30A and a second color erasing device 30B in a double structure are disposed at the sheet conveying path section 31 along the horizontal direction and perform a color erasing process by means of heating on the sheet S twice as with the second embodiment shown in FIG. 6. A vertical positional relationship between the first roller (first heating member and third heating member) 22 and the second roller (second heating member and fourth heating member) 23 is reversed between the first color erasing device 30A and the second color erasing device 30B.

In the present embodiment, no reflector 27 may be provided in the second heating section 13B in the second color erasing device 30B as with the second embodiment. Moreover, as with the first embodiment, the heat retention cover 32 partially covering the outer periphery of the second roller 23 may be provided on the downstream side in the sheet conveying direction, which is the opposite side of the reflector 27 with the second roller 23 interposed therebetween, thereby preventing a reduction in the surface temperature of the second roller 23. At this time, the heat retention cover 32 may be provided for both of the second rollers 23 in the first color erasing device 30A and the second color erasing device 30B as shown in FIG. 8, or the heat retention cover 32 may be provided only for the second roller 23 in any one of the first color erasing device 30A and the second color erasing device 30B.

Moreover, the first heat source and the third heat source for heating the first rollers 22 respectively forming the first heating member and the third heating member and the second heat source 26 and the fourth heat source 26 for heating the second rollers 23 respectively forming the second heating member and the fourth heating member can be temperature-controlled in the same manner as that of the first embodiment.

Although the second color erasing device has been described as having the same configuration as that of the first color erasing device, the configuration of the second color erasing device 3B is not limited thereto. The second color erasing device may have a configuration different from that of the first color erasing device in structure, size, and the like. The fourth heating member may have a configuration heated from outside thereof as with the second heating member.

The embodiments may be embodied in other various forms without departing from the spirit or essential characteristics thereof. The above-described embodiments are therefore to be considered in all respects as illustrative and not restrictive. The scope of the embodiments is indicated by the appended claims, but not restricted by the foregoing description. Further, all changes, various improvements, substitutions and modifications which come within the meaning and range of equivalency of the claims are therefore intended to be embraced therein.

What is claimed is:

1. An erasing apparatus comprising a color erasing device configured to heat a sheet having an image formed thereon using a color material that is color erased at a predetermined color erasing temperature so as to erase color of the image, the color erasing device comprising:

a sheet conveying path along which a sheet is conveyed from a lower side to an upper side of a body of the erasing apparatus in a vertical direction;

a first heating member including a metal roller and configured to be heated to a temperature greater than or equal to the color erasing temperature by a first heat source located inside a cavity of the metal roller, and to be in contact with a first surface of the sheet being conveyed;

a second heating member including an elastic roller formed with an elastic member, the second heating member positioned to face the first heating member with the sheet conveying path therebetween, and to be in contact with a second surface opposite the first surface of the sheet being conveyed, and to form a nip portion with the first heating member through which the sheet is passed;

a second heat source positioned lower than the second heating member in the vertical direction and configured to radiate heat to heat the second heating member;

a guiding section forming a portion of the sheet conveying path from the lower side of the body to the nip in the sheet conveying path, the guiding section comprising:

a first guiding section arranged on a first heating member side of the sheet conveying path and positioned lower than the first and second heating members in the vertical direction, a second guiding section arranged on a second heating member side of the sheet conveying path, approximately in parallel with the first guiding section, and positioned lower than the first and second heating members in the vertical direction, and a third guiding section arranged on the second heating member side of the sheet conveying path, approximately in parallel with the first guiding section, positioned lower than the second heating member and higher than the second guiding section in the vertical direction, configured to be in sliding contact with the second surface of the sheet, and made of a heat conductive material to distribute heat from the second heat source to the sheet along a length of the sheet before the sheet is conveyed to the nip portion;

a reflective member comprising:

a first reflective section arranged facing the second heating member with the second heat source therebetween, positioned higher than the first reflective section in the vertical direction, and configured to reflect heat received from the second heat source toward the second heating member, wherein a lower side end of the third guiding section is connected to one end of the first reflective section; and a second reflective section connected to the other end of the first reflective section opposite the one end, and extending towards the second heat source;

a heat retention cover facing the first reflective section with the second heating member therebetween and positioned higher than the second heating member in the vertical direction, the heat retention cover covering the outer periphery of the second heating member, the heat retention cover including a fourth guiding section forming a portion from the nip to the upper side of the body in the conveyance path; and a sensor positioned in contact with the second heating member through a gap between the second reflective section and the heat retention cover and configured to detect the temperature of the second heating member.

2. The erasing apparatus according to claim 1, further comprising:

a third heating member positioned higher than the first heating member and the second heating member in the vertical direction and configured to be in contact with the second surface of the sheet;

a third heat source configured to heat the third heating member to a temperature greater than or equal to the color erasing temperature; and a fourth heating member provided at a position facing the third heating member and configured to be in contact with the first surface of the sheet.

3. The erasing apparatus according to claim 2, further comprising a fourth heat source configured to heat the fourth heating member from outside thereof.

4. The erasing apparatus according to claim 3, further comprising a third reflective member facing the fourth heating member with the fourth heat source therebetween and having a reflective surface configured to reflect heat received from the fourth heat source toward the fourth heating member, the third reflective member including a fifth guiding section configured to be in sliding contact with the first surface of the sheet being conveyed and configured to guide the sheet to a second nip portion formed between the third heating member and the fourth heating member, the fifth guiding section being heated by the fourth heat source, wherein the fifth guiding section is linear and made of a heat conductive material to distribute heat from the fourth heat source to the sheet along a length of the sheet before the sheet is conveyed to the second nip portion.

5. The erasing apparatus according to claim 1, wherein the first heat source heats the first heating member at a first temperature, and the second heat source heats the second heating member at a second temperature higher than the first temperature.

6. The erasing apparatus according to claim 1, wherein the first heat source heats the first heating member at a first temperature, and the second heat source heats the second heating member at a second temperature greater than or equal to the color erasing temperature and lower than the first temperature.

7. The erasing apparatus according to claim 1, further comprising:

a paper feeding section configured to feed the sheet;

a discharged paper tray section configured to collect and stack the sheet;

a first conveying path forming a portion of the sheet conveying path and configured to convey the sheet fed from the paper feeding section;

a reading section configured to read an image on the sheet being conveyed on the first conveying path;

a second conveying path forming another portion of the sheet conveying path on which the color erasing device is disposed, the second conveying path branching from the first conveying path at a branching section positioned lower than the reading section in the vertical direction and merging into the first conveying path at a merging section positioned higher than the reading section in the vertical direction; and a controller configured to determine if a color erasing process has been adequately performed or not based on read information from the reading section, and selectively discharge the sheet being conveyed on the first conveying path to the discharged paper tray section based on the determination result.

8. An erasing apparatus comprising:

conveying means configured to convey a sheet having an image formed thereon using a color material that is color erased at a predetermined color erasing temperature, the conveying means including a sheet conveying path along which the sheet is conveyed from a lower side to an upper side of a body of the erasing apparatus in a vertical direction;

first heating means configured to be heated to a temperature greater than or equal to the color erasing temperature by first heat source means located inside a cavity of the first heating means, and to be in contact with a first surface of the sheet being conveyed, the first heating means including a metal roller;

second heating means including an elastic roller formed with an elastic member, the second heating member positioned to face the first heating member with the sheet conveying path therebetween, and to be in contact with a second surface opposite the first surface of the sheet being conveyed and to form a nip portion with the first heating means through which the sheet is passed;

second heat source means positioned lower than the second heating means in the vertical direction and configured to radiate heat to heat the second heating means;

a guiding means forming a portion of the sheet conveying path from the lower side of the body to the nip in the sheet conveying path, the guiding section comprising:

a first guiding section arranged on the first heating means side of the sheet conveying path and positioned lower than the first and second heating means in the vertical direction, a second guiding section arranged on a second heating means side of the sheet conveying path, approximately in parallel with the first guiding section, and positioned lower than the first and second heating members in the vertical direction, and a third guiding section arranged on the second heating means side of the sheet conveying path, approximately in parallel with the first guiding section, positioned lower than the second heating means and higher than the second guiding section in the vertical direction, configured to be in sliding contact with the second surface of the sheet, and made of a heat conductive material to distribute heat from the second heat source means to the sheet along a length of the sheet before the sheet is conveyed to the nip portion;

reflective means comprising:

a first reflective section arranged facing the second heating means with the second heat source means therebetween, positioned higher than the first reflective section in the vertical direction, and configured to reflect heat received from the second heat source means toward the second heating means, wherein a lower side of the third guiding section is connected to one end of the first reflective section, and a second reflective section connected to the other end of the first reflective section opposite the one end, and extending towards the second heat source;

a heat retention means facing the first reflective member with the second heating member therebetween and positioned higher than the second heat source means in the vertical direction, the heat retention means covering the outer periphery of the second heat source means, the heat retention means including a fourth guiding section forming a portion from the nip to upper side of the body in the conveyance path; and a sensor positioned in contact with the second heating means through a gap between the second reflective section and the heat retention cover and configured to detect the temperature of the second heating means.

9. The erasing apparatus according to claim 8, further comprising:

a third heating means positioned higher than the first heating means and the second heating means in the vertical direction and configured to be in contact with the second surface of the sheet;

third heat source means configured to heat the third heating means to a temperature greater than or equal to the color erasing temperature; and fourth heating means provided at a position facing the third heating means and configured to be in contact with the first surface of the sheet.

10. The erasing apparatus according to claim 9, further comprising fourth heat source means configured to heat the fourth heating means from outside thereof.

11. The erasing apparatus according to claim 10, further comprising a third reflective means facing the fourth heating means with the fourth heat source means therebetween and configured to reflect heat received from the fourth heat source means toward the fourth heating means, the third reflective means including a fifth guiding section configured to come into sliding contact with the first surface of the sheet being conveyed and to guide the sheet to a second nip portion formed between the third heating means and the fourth heating means and being heated by the fourth heat source means, wherein the fifth guiding section is made of a heat conductive material to distribute heat from the fourth heat source means to the sheet along a length of the sheet before the sheet is conveyed to the second nip portion.

12. The erasing apparatus according to claim 8, further comprising:

reading means configured to read an image on the sheet after being subjected to a color erasing process;

a plurality of stacking means each configured to stack thereon sheets after being subjected to the color erasing process; and controlling means configured to determine if the sheet is reusable or not based on read information from the reading means and select a sheet conveyance destination from among the plurality of stacking means based on the determination result.

* * * * *